US007105754B2

(12) United States Patent
Turner

(10) Patent No.: US 7,105,754 B2
(45) Date of Patent: Sep. 12, 2006

(54) MULTI-FUNCTIONAL CONTROL ASSEMBLY FOR USE IN ELECTRIC GUITARS

(75) Inventor: William Turner, Corona, CA (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 10/455,488

(22) Filed: Jun. 3, 2003

(65) Prior Publication Data

US 2004/0245080 A1 Dec. 9, 2004

(51) Int. Cl.
*H01H 9/00* (2006.01)

(52) U.S. Cl. ..... 200/4; 200/14

(58) Field of Classification Search ..... 200/4, 200/5 R, 14, 336, 341; 84/267, 290–293, 84/738

See application file for complete search history.

(56) References Cited

U.S. PATENT DOCUMENTS 3,312,925 A 4/1967 Frantz
3,437,282 A 4/1969 Honkonen
4,602,547 A * 7/1986 Nyack, Jr. et al. ..... 84/726
4,866,219 A * 9/1989 Riding et al. ..... 200/4
5,436,413 A * 7/1995 Katakami ..... 200/14
5,549,026 A * 8/1996 Gay, Jr. ..... 84/292
5,837,912 A * 11/1998 Eagen ..... 84/267
5,847,335 A * 12/1998 Sugahara et al. ..... 200/4
5,867,082 A * 2/1999 Van Zeeland ..... 200/521 X
5,959,267 A 9/1999 Kawasaki et al.
6,034,316 A * 3/2000 Hoover ..... 84/738
6,049,044 A 4/2000 Mizobuchi
6,051,765 A * 4/2000 Regenberg et al. ..... 84/293
6,059,660 A 5/2000 Takada et al.
6,667,446 B1 * 12/2003 Schuberth et al. ..... 200/4
6,794,770 B1 9/2004 Kirby

* cited by examiner

*Primary Examiner*—Michael A. Friedhofer
(74) *Attorney, Agent, or Firm*—Robert D. Atkins; Quarles & Brady Streich Lang LLP

(57) ABSTRACT

A multi-functional control assembly having a rotary controller with a push-button switches contained therein. The rotary controller has a shaft. A bore is formed through the shaft. A communicator extends through the bore and is configured to communicate information regarding the push-button switch through the bore.

19 Claims, 5 Drawing Sheets

MULTI-FUNCTIONAL CONTROL ASSEMBLY FOR USE IN ELECTRIC GUITARS

FIELD OF THE INVENTION

The present invention relates generally to electric control mechanisms and more specifically to electric control mechanisms for use with electric guitars. The present invention relates more particularly to a multi-functional electric control assembly having a rotary control knob that facilitates rotational control of an electric signal and an integral push button disposed within the rotary knob allowing for actuation of a switch without changing the height of the control assembly from the mounting surface.

BACKGROUND OF THE INVENTION

Typically, selector switches and potentiometers are utilized to control an electric guitar. A selector switch, for example, is utilized for selecting a desired combination of pickups. The selector switch allows a desired one or more of multiple pickups to be selected and placed in either a parallel or series configuration. Potentiometers are utilized to control tone and volume for modifying the sound provided by the electric guitar. The volume control allows a guitarist to vary the volume of the instrument while the tone control allows the guitarist to vary the tone of the electric guitar. Typically, the selector switch and potentiometer functions are not combined in a single control mechanism.

While there are practical advantages to combining selector switch and potentiometer functions a single control mechanism, such mechanisms have not found general use in electric guitars. Typical rotary control mechanisms must have sufficient gripping surface for operation which causes the mechanism to extend up from the mounting surface of the guitar. A typical push-button switch must also have sufficient clearance between the switch and the mounting surface of the guitar so as to facilitate inward movement of the switch. Such clearance inherently necessitates that the combined push-button/rotary control mechanism sit higher, i.e., extend further away from the mounting surface on body of the guitar, than would be necessary if the mechanism were not pushed inwardly so as to effect actuation of the push-button switch thereof. As a result, typical push-button/rotary control mechanisms have proved unsatisfactory for use with electric guitars due to significant change in the instrument's profile resulting from the added height of the combined control mechanism. For example, the additional height needed for travel of the push button switch results in the mechanism extending a greater distance than normal from the surface of the guitar. The result is that when a contemporary rotary/push-button switch is used on an electric guitar, it is likely (if not inevitable) that pushing the knob will also result in some undesirable amount of rotation of the knob which in turn undesirably varies the volume or tone of the guitar. Further, added height can result in inadvertently pushing the switch resulting in a dramatic change in the sound of the guitar. The use of such mechanisms may require the musician to strum the guitar differently to allow for the presence of the higher control mechanism. As such conventional push-button/rotary control mechanisms have not found general use in electrical guitars.

In view of the foregoing, it is desirable to provide a electric control assembly which facilitates selection of a desired combination of pickups (for example), which mitigates the likelihood of inadvertent operation thereof, and which is suitable for use on electric guitars, as well as in various other applications.

SUMMARY OF THE INVENTION

The present invention specifically addresses and alleviates the above-mentioned deficiencies associated with conventional push-button/rotary control mechanisms. More particularly, the present invention comprises a multi-functional control assembly comprising a first rotary control knob having a shaft, a bore formed through the shaft, and a communicator extending through the bore. The communicator is configured to communicate information regarding the second push-button switch through the bore. The multi-functional control assembly of the present invention allows for combined rotary and push-button control without changing the distance of the control assembly from the mounting surface.

These, as well as other advantages of the present invention, will be more apparent from the following description and drawings. It is understood that changes in the specific structure shown and described may be made within the scope of the claims without departing from the spirit of the invention.

BRIEF DESCRIPTION OF THE DRAWINGS

These, and other features, aspects and advantages of the present invention will be more fully understood when considered with respect to the following detailed description, appended claims and accompanying drawings, wherein:

DETAILED DESCRIPTION OF THE INVENTION

The detailed description set forth below in connection with the appended drawings is intended as a description of the presently preferred embodiments of the invention, and is not intended to represent the only forms in which the present invention may be constructed or utilized. The description sets forth the functions of the invention and the sequence of steps for constructing and operating the invention in connection with the illustrated embodiments. It is to be understood, however, that the same or equivalent functions and sequences may be accomplished by different embodiments that are also intended to be encompassed with the spirit and scope of the invention.

Figure 13:
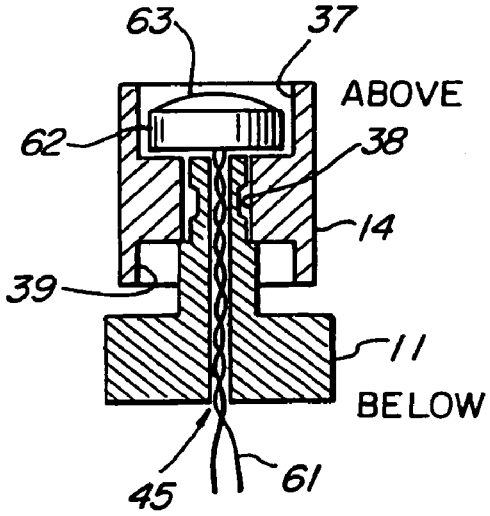
FIG. 13 is a semi-schematic, cross-sectional side view of a second embodiment of the control assembly of the present invention, wherein a push-button switch is disposed above the potentiometer.
Figure 14:
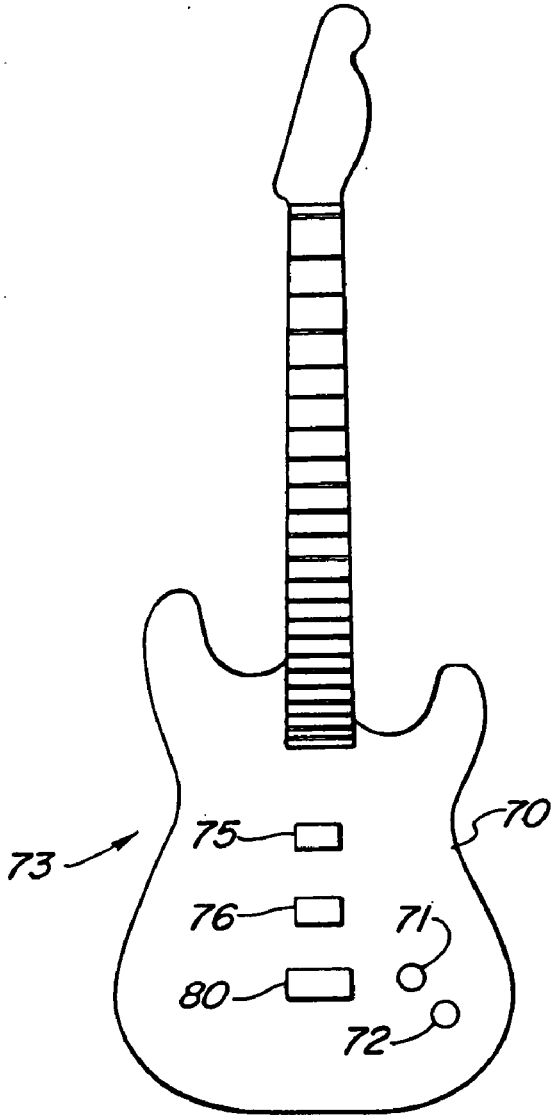
FIG. 14 is a semi-schematic, top view of a guitar having two multi-functional control assemblies according to the present invention, wherein one control assembly facilitates volume control and on/off control of a preamplifier and wherein the other control assembly facilitates tone control and selection of a desired pickup or combination of pickups.
Figure 15:
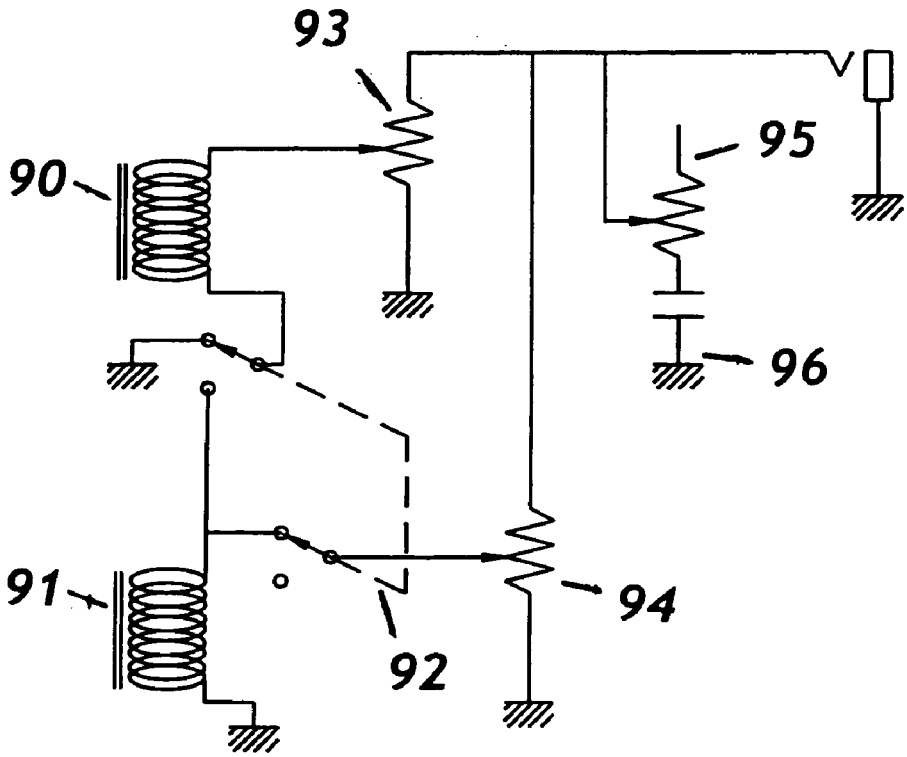
FIG. 15 is a circuit diagram illustrating the use of the multi-functional control assembly of the present invention to control volume, tone and the combination of neck and bridge pick-ups of an electric guitar.
Figure 16:
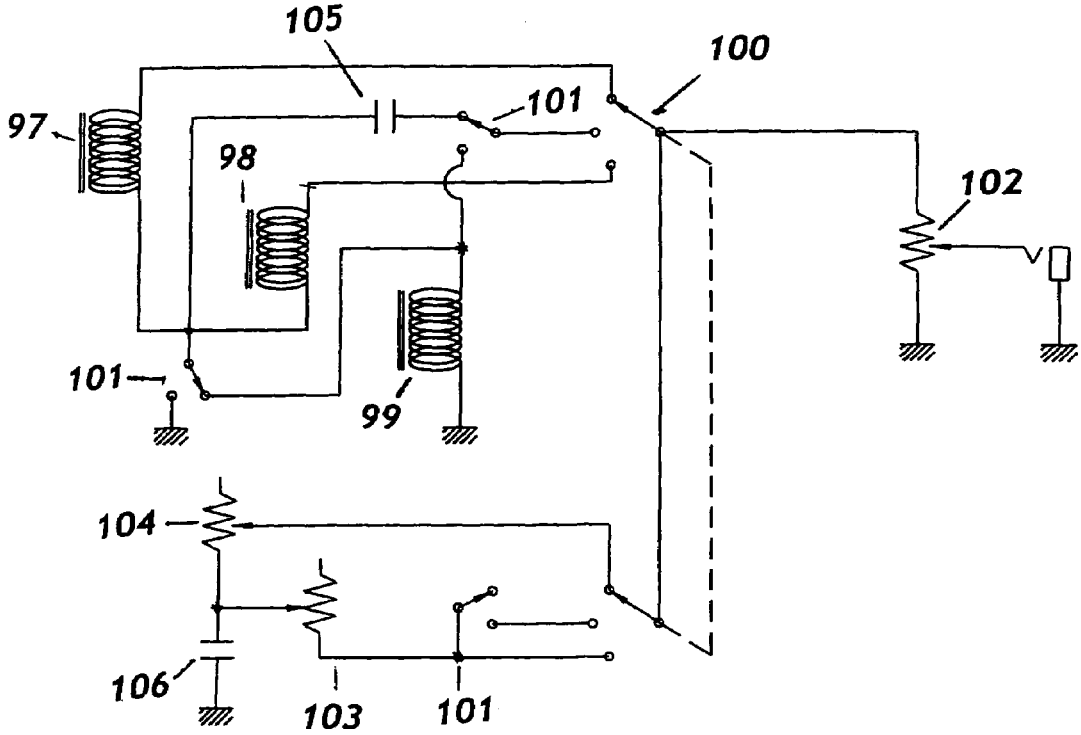
FIG. 16 is a circuit diagram illustrating the numerous pick-up combinations possible from the use of the multi-functional control assembly of the present invention in a three pick-up electric guitar having a 5-way lever switch.

The multi-functional control assembly of the present invention is illustrated in FIGS. 1–16 of the drawings. FIGS. 1–12 depict a first embodiment of the control assembly. FIG. 13 depicts a second embodiment of the control assembly. FIG. 14 depicts an electric guitar having two multi-functional control assemblies of the present invention attached to the body thereof, wherein each control assembly can be either the first or second embodiment of the present invention. FIGS. 15–16 depict circuit diagrams illustrating the use of the multi-functional control assemblies of the present invention to control volume, tone and the relationship of multiple pick-ups of an electric guitar.

The multi-functional control assembly of the present invention provides an integrated, double control assembly, wherein a push button is conveniently disposed within a rotatable knob. Thus, according to the present invention, the push button is not easy to inadvertently actuate. Additionally, less room or surface area is required for the two controllers of the control assembly of the present invention, since the push button is disposed within the knob and since a push-button switch is disposed either above or below a rotary switch, rather than next to the rotary switch (which would require a larger mounting surface).

Figure 1:
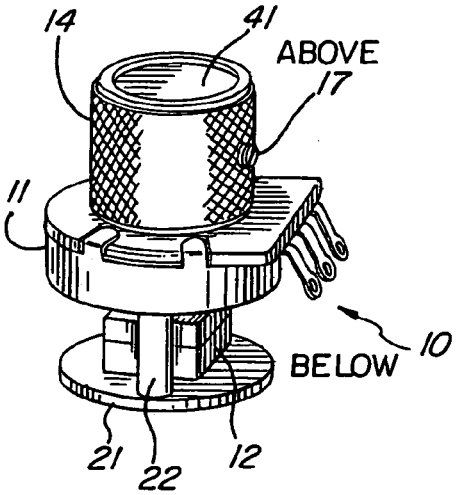
FIG. 1 is a semi-schematic, perspective view of an exemplary first embodiment of a multi-functional control assembly according to the present invention, wherein a push-button switch is disposed below a potentiometer.
Figure 2:
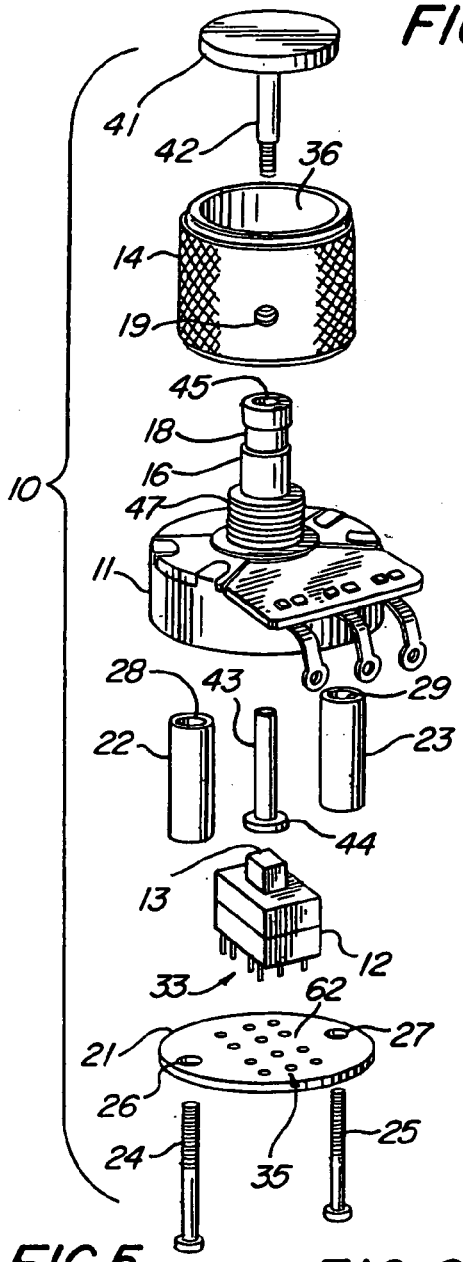
FIG. 2 is a semi-schematic, perspective exploded view of the control assembly of FIG. 1.

Referring now to FIGS. 1 and 2, a first embodiment of the control assembly 10 of the present invention comprises a rotary controller, such as potentiometer 11, below which is disposed a push-button switch 12.

The rotary controller alternatively comprises any other type of controller having a rotatable shaft which facilitates actuation or modification of the state thereof. Thus, the rotary controller may alternatively comprise a selector (where a rotation of a shaft facilitates the making and breaking of a plurality of electrical contacts), a variable capacitor, a variable resistance, or a variable inductance, for example.

The push-button switch 12 may comprise any suitable switch which is actuated or which the state of is changed by depressing a button or other structure. Actuation of the push-button switch 12 may result in the making and/or breaking of one or a plurality of circuits, in any desired combination or sequence.

According the first embodiment of the present invention, the push-button switch 12 is disposed below the potentiometer 11, and is configured such that a push button 13 (shown in FIG. 2) thereof can be actuated from above the potentiometer 11, as discussed in detail below Thus, according to the first embodiment of the present invention, the information regarding the second switch which is communicated through the bore is information regarding the desired state of the second switch. That is, the information communicated through the bore is information which causes the second switch to move to a different, desired state. In this instance, the information is that information conveyed by the pushing of push button 41.

As discussed in detail below, according to a second embodiment of the present invention, the information regarding the second switch which is communicated through the bore comprises information regarding the actual state of the second switch. In this instance, the information is conveyed by electrical signals.

Preferably, a knob, such as knurled knob 14, is attached to a shaft 16 of the potentiometer, such as via set screw 17, which is disposed within threaded opening 19, and which engages neck 18 of the shaft 16. Those skilled in the art will appreciate that various other means for effecting rotation of the shaft 16 are likewise suitable and that various other methods for attaching the knob 14 to the shaft 16 are likewise suitable.

According to the preferred embodiment of the present invention, the push-button switch 12 is mounted below the potentiometer 11 via base 21, spacers 22 and 23, and screws 24 and 25. Thus, screws 24 and 25 pass through openings 26 and 27 formed in the base 21 and pass through bores 28 and 29 formed longitudinally through the spacers 22 and 23, to be received within threaded openings 31 and 32 (shown in FIG. 5) formed in the bottom of the potentiometer 11. Preferably, the base 21 is formed of an insulating material, such as a polymer, paperboard, or phenolic. The base 21 may optionally define a circuit board or a portion of a circuit board, such as a printed circuit board. Leads 33, which extend downwardly from the bottom of the push-button switch 12, extend through corresponding openings 35 formed in the base 21. Optionally, the leads 32 are soldered or otherwise attached to the base 21. Optionally, the push-button switch 12 is adhesively bonded to the base 21. Alternatively, the push-button switch 12 may be attached to the base 21 via any other desired method, such as via the use of fasteners. Preferably, the clamping action of the base 21 with respect to the potentiometer 11, caused by tightening of the screws 24 and 25, is sufficient to maintain desired placement of the push-button switch 12 with respect to the potentiometer 11.

The knob 14 has a bore 36 formed longitudinally therethrough. The bore 36 is preferably generally circular in cross-section. However, the bore 36 may have any other desired cross-section.

Similarly, the shaft 16 of the potentiometer 11 has a bore 45 formed generally longitudinally therethrough. The bore 45 is preferably formed by drilling longitudinally through the shaft 16. However, the bore 45 may be formed via any other desired method and may optionally be formed in the shaft 16 at the time the shaft 16 is formed in a molding or other process. That is, the bore 45 may optionally be molded or extruded into the shaft 16 at the time the shaft 16 is formed.

Figure 3:
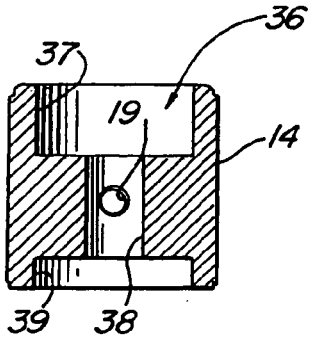
FIG. 3 is a semi-schematic, cross-sectional side view of the knob of FIG. 1.

Referring now to FIG. 3, the bore 36 formed longitudinally through the knob 14 preferably comprises an top portion 37, a middle portion 38 and a bottom portion 39. The middle portion 38 preferably has a reduced diameter with respect to the top portion 37 and the lower portion 39. The top portion 37 is configured so as to receive a push button 41 (FIG. 2), as discussed in detail below. The middle portion 38 is configured so as to receive the shaft 16 of the potentiometer 11. The bottom portion 39 is configured so as to receive a threaded portion 47 of the potentiometer 11. The top portion 37, the middle portion 38 and the bottom portion 39 may be formed via drilling and/or counter boring. Alternatively, the top portion 37, the middle portion 38 and the bottom portion 39 may be molded into the knob 14 when the knob 14 is formed. Those skilled in the art will appreciate that various other methods for forming the top portion 37, the middle portion 38 and bottom portion 39 in the knob 14 are likewise suitable.

Referring again to FIG. 2, the push button 41 has a pushrod extending downwardly therefrom. According to one preferred method for forming the pushrod, the pushrod comprises an upper pushrod portion 42 and a lower portion 43. Optionally, the lower pushrod portion 43 has a head 44 formed at the lowermost portion thereof. The pushrod 42 extends downwardly from the push button 41 through a bore 45 formed longitudinally through the shaft 16 of the potentiometer 11. In this manner, the lowermost portion, such as the head 44, of the pushrod contacts the push button 13 and is thus capable of actuating the push-button switch 12. That is, by pushing or depressing the push button 41, the push-button switch 12 can be actuated.

Figure 4:
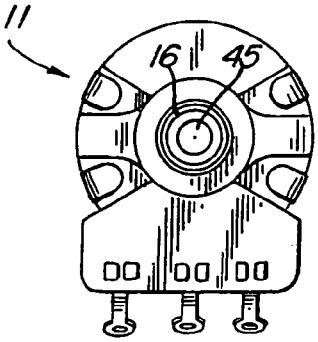
FIG. 4 is a semi-schematic, top view of the potentiometer of FIG. 1.
Figure 5:
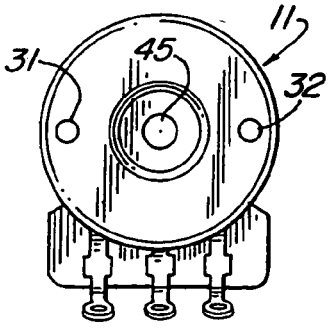
FIG. 5 is a semi-schematic, bottom view of the potentiometer of FIG. 1.

Referring now to FIGS. 4 and 5, the bore 45 can be seen extending from the top of the potentiometer 11 (as shown in FIG. 4), through the potentiometer 11, to the bottom of the potentiometer 11 (as shown in FIG. 5). As discussed above, the threaded openings 31 and 32 (as shown in FIG. 5) receive the screws 24 and 25 to facilitate attachment of the push-button switch 12 to the potentiometer 11.

Figure 6:
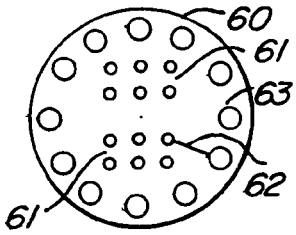
FIG. 6 is a semi-schematic, plan view of a printed circuit board for communicating electrical signals to and from the leads of the push-button switch.

Referring now to FIG. 6, an exemplary printed circuit-board 60, which may be either attached to the base 21, or may alternatively define the base 21, facilitates communication of electrical signals to and from the leads 33 of the push-button switch 12. Plated through holes 61 receive the leads 33 of the push-button switch 12, which are typically soldered thereto. Conductive conduits or traces 62 (only one of which is shown, for clarity) extend from each via to a corresponding pad 63. The pads 63 facilitate interconnection with other desired electrical components, according to well known principles. Alternatively, the conductive conduit 62 may extend from each via 61 to a corresponding post, lead, or other desired electrical interconnection facilitating element or to any desired element or circuit. Those skilled in the art will appreciate that electrical connection to the leads 33 may be accomplished via various other methods. Indeed, wires may be soldered directly to the leads 33, if desired.

Figure 7:
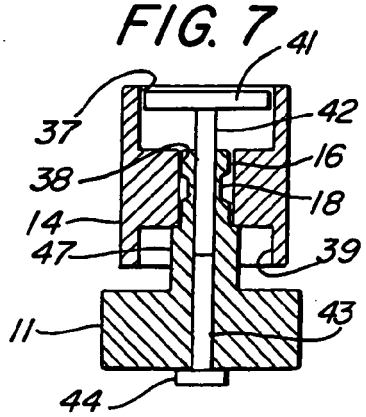
FIG. 7 is a semi-schematic, cross-sectional side view of the control assembly of FIG. 1, showing a pushrod in a non-pushed position thereof and having the push-button switch removed therefrom for clarity.
Figure 8:
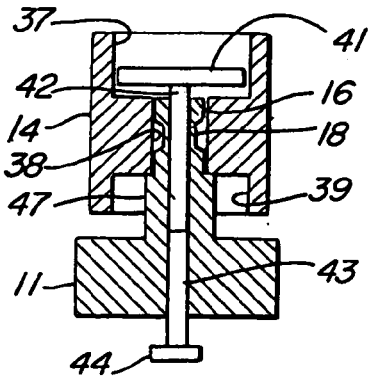
FIG. 8 is a semi-schematic, cross-sectional side view of the control assembly of FIG. 1, showing the pushrod in a pushed position thereof and having the push-button switch removed therefrom for clarity.

Referring now to FIGS. 7 and 8, longitudinal movement of the pushrod (which is comprised of upper pushrod portion 42 and lower pushrod portion 43) through the bore 45 of the shaft 16 of the potentiometer 11, is shown.

With particular reference to FIG. 7, the pushrod is shown in approximately its uppermost or unactuated position. In this position, the pushrod does not depress the push button 13 of the push-button switch 12 (FIG. 2). Preferably, the push-button switch 12 comprises a spring which biases the push button 13 thereof upwardly, such that the push button 13 similarly biases the pushrod upwardly. In this manner, the push button 41 formed at the uppermost end of the pushrod tends to be maintained approximately flush with the upper surface of the knob 14 or tends to be maintained slightly below the upper surface of the knob 14.

With particular reference to FIG. 8, the push button 41 is shown in approximately its lowermost or depressed position, so as to cause the pushrod to translate downwardly through the bore 45 formed in the shaft 16. In this manner, the head 44 formed upon the lowermost portion of the bottom pushrod position 43 urges the push button 13 of the push-button switch 12 downwardly, so as to actuate the push-button switch 12. Thus, the pushrod functions as a communicator to communicate a desire to change the state of the push-button switch 12.

Figure 9:
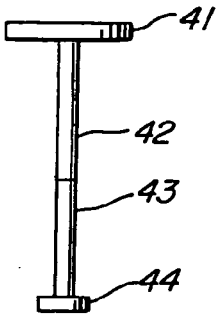
FIG. 9 is a semi-schematic, side view of the pushrod of FIGS. 6 and 7.

Referring now to FIG. 9, the top pushrod section 42 and bottom pushrod section 43 are preferably attached to one another, so as to define a generally integral and continuous pushrod.

Figure 10:
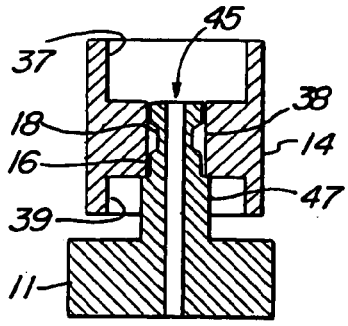
FIG. 10 is a semi-schematic, cross-sectional side view of the control assembly of FIGS. 7 and 8, having the pushrod removed therefrom.

Referring now to FIG. 10, the pushrod and the button 41 are shown removed from the knob 14 and the shaft 16. It can easily be seen that movement of the pushrod can be communicated through the bore 45 of the shaft 16, so as to facilitate actuation of the push button 12.

Figure 11:
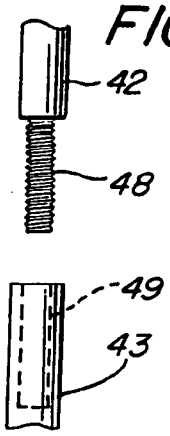
FIG. 11 is a semi-schematic, enlarged side view of a connection mechanism of the top and bottom pushrod sections.

Referring now to FIG. 11, the top pushrod section 42 may be attached to the bottom pushrod section 43 via threads 48 formed upon one of the pushrod sections, e.g., the top pushrod section 42, which are received within threaded opening 49 formed within the other of the pushrod sections, e.g., as bottom pushrod section 43.

Figure 12:
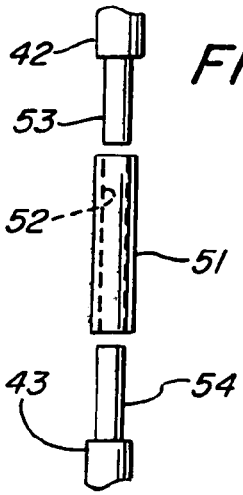
FIG. 12 is a semi-schematic, enlarged side view of an alternative connection mechanism of the top and bottom pushrod section.

Referring now to FIG. 12, alternatively, the top pushrod section 42 may be attached to the bottom pushrod section 43 by providing an intermediate pushrod section or sleeve 51 having a bore 52 formed therein which receives a post 53 formed upon the lowermost end of the top pushrod section 42 and similarly receives a post 54 formed upon the uppermost portion of the bottom pushrod section 43. The posts 53 and 54 may be friction fit into the bore 52, so as to facilitate desired semi-permanent attachment of the top pushrod section 42 to the bottom pushrod section 43. Alternatively, the posts 53 and 54 may be adhesively bonded to the sleeve 51. Alternatively, the posts 53 and 54 may be threaded to the sleeve 51.

Those skilled in the art will appreciate that various other methods for attaching the top pushrod section 42 to the bottom pushrod section 43 are likewise suitable. Indeed, the top pushrod section 42 does not need to be attached to the bottom pushrod section 43, as long as each pushrod section is captured within the rotary control assembly of the present invention. For example, the bottom pushrod section 43 is captured within the rotary control assembly as shown in FIG. 2, since it is disposed intermediate the push-button switch 12 and the potentiometer 11 and slides within the bore 45 of the shaft 16 and therefore cannot undesirably escape from the rotary control assembly. In a similar fashion, a detent, set screw, or other structure may be provided proximate the top of the knob 14, so as to capture the top pushrod section 42.

Referring now to FIG. 13, a second embodiment of the multi-function control assembly of the present invention is shown. According to the second embodiment of the present invention, a push-button switch 62 is disposed above the potentiometer 11 and a pair of wires 61 extend downwardly through the bore 45 formed in the shaft 16. The push-button switch 62 may be attached to the knob 14, such as via adhesive bonding, such that the push-button switch 62 rotates along with the knob 14.

Alternatively, the push-button switch may be mounted upon a substantially rigid bar or other elongate member which is disposed within the bore 45 of the potentiometer 11 and which is mounted to the guitar body 70 via any desired means. Conductors may be formed inside the elongate member, on the surface of the elongate member, or otherwise outside of the elongate member.

Indeed, the elongate member upon which the push-button switch 62 is mounted can be a conductive rod which defines one conductor for the push-button switch 62. The other conductor for the push-button switch 62 may be defined by an insulated wire which is disposed within a bore of the conductive rod or by a conductive sleeve which is separated from the conductive rod by an insulator and within which the conductive rod is disposed. The unique configuration of the present invention permits the use of wire connections since the rotary knob rotates independent of the switch thus avoiding twisting and breakage of the wire connections. Those skilled in the art will appreciate that various other means for mounting the push-button switch 62 and for providing two or more conductive conduits thereto are likewise suitable.

Thus, the second embodiment of the present invention is operated by a user in a fashion similar to the first embodiment of the present invention. That is, depressing push button 63, such as with a finger, effects the making and/or breaking of electrical contacts within the push-button switch 62. According to the second enbodiment of the present invention, informating regarding the state of the push-button switch 62 is communicate through the bore 45 of the potentiometer via wire 61.

Referring now to FIG. 14, a first 71 and a second 72 multi-functional control assembly according to the present invention are installed upon a body 70 of a guitar 73 proximate the bridge 80, so as to facilitate desired operation of the guitar 73.

For example, the first control assembly 71 may vary the volume of the guitar 73 by rotating the knob 14 (FIG. 1 or FIG. 13) thereof and may switch on or off a preamplifier or other electronic effect or function or circuit contained within the body 70 by depressing the push button 41 (FIG. 1) or 63 (FIG. 7) thereof. In a similar fashion, the control assembly 72 may vary a tone of the electric guitar 73 by rotating the knob 14 thereof and may select any desired combination of the first pickup 75 and the second pickup 76 by repeatedly depressing the button 41 or 63 thereof.

FIG. 15, illustrates the use of the multi-functional control assembly of the present invention in a two pick-up electric guitar having Neck 90 and Bridge 91 pick-ups. The switch 92 of the multi-functional control assembly is used to control the combination of the two pick-ups 90 and 91. When the switch 92 is in the OFF (Up) position the pick-ups are in a parallel configuration. When the switch 92 in the in ON (Down) position the pick-ups are in a series configuration. The switch is contained within rotary controller 93 which controls the volume of the Neck pick-up 90 when the switch is in the OFF position and the pick-ups are in parallel configuration. The volume of the Bridge pick-up 91 is controller by rotary controller 94. Rotary controller 95 is a master controller controlling the tone of both the Neck and Bridge pick-ups electrically coupled to a 0.05 uF capacitor 96. When the switch 92 is in its ON position the pick-ups are in series configuration rotary controller 93 becomes a master volume controlling the volume of both pick-ups 90 and 91.

FIG. 16 illustrates the many pick-up configurations made possible by use of the multi-functional control assembly of the present invention. FIG. 16 illustrates the electric circuitry of an electric guitar having three pick-ups, Neck pick-up 97, Bridge pick-up 98, and Middle pick-up 99 and a five-way lever switch 100. The multi-functional control assembly is used to control volume and to vary the configuration of the pick-ups. As illustrated in the table below, depending the position of five-way lever switch 100, switch 101 of the multi-functional control assembly can be turned OFF (Up) or ON (Down) to effect different configurations of the pick-ups.

| 5-Way LVR SW Pos. | SW-1-OFF (Up) | SW-1-ON (Down) |
|---|---|---|
| 1 | Bridge P.U. | Bridge P.U. × Middle P.U. |
| 2 | Bridge P.U. + Middle P.U. | (Bridge P.U. + .05 uF Cap) × Middle P.U. |
| 3 | Middle P.U. | .05 uF Cap × Middle P.U./No Tone Cntl |
| 4 | Middle P.U. + Neck P.U. | (Neck P.U. + .05 uF Cap) × Middle P.U. |
| 5 | Neck P.U. | Middle P.U. × Neck P.U. |

Wherein "+" means parallel connection and "x" means series connection. Further, as illustrated in FIG. 16 the circuit includes rotary controller 102 to pick-up volume, rotary controller 103 to control Middle 99 and Bridge 98 pick-up tone, rotary control 104 to control Neck pick-up 97 tone, 0.05 uF capacitor 105, and a 0.022 uF capacitor 106.

Any desired combination of the first embodiment (shown in FIGS. 1–11) and the second embodiment (shown in FIG. 13) of the multi-functional control assembly of the present invention may be utilized on the guitar body 70, or in any other desired application.

Optionally, the multi-functional control assembly of the present invention may be configured so as to perform multiple functions. For example, the push-button switch thereof may provide a signal to a microprocessor which then controls desired circuitry, such as a preamplifier, digital tone and/or volume control circuitry, digital effects circuitry or any other desired circuitry. Thus, pushing the push-button switch may selected a desired effect, such as distortion, flanging, or chorus and rotating the rotary switch may define a perimeter of the effect, such as the time delay associated thereof.

Optionally, one or more LEDs or other display device (such as a liquid crystal alpha-numeric display) may be provided, such as upon either the body of the guitar or the control assembly itself, so as to indicate the function of the push-button and/or rotary switch.

It is understood that the exemplary multi-functional control assembly described herein and shown in the drawings represents only presently preferred embodiments of the present invention. Indeed, various modifications and additions may be made to such embodiments without departing from the spirit and scope of the invention. For example, various means for attaching the knob to the shaft are contemplated. Further, various means for fixing the push-button switch in position with respect to the rotary control mechanisms are likewise contemplated. Indeed, the push-button switch need not be disposed immediately below the rotary control mechanism, but rather may be disposed some distance therebelow, by extending the length of the pushrod accordingly.

According to the present invention, both the first and second multi-functional control assemblies can be rotary switches, wherein the second rotary controller is actuated or rotated via a shaft which passes through the first rotary controller. Further, according to the present invention, both the first and second control assemblies can be push-bottom switches, wherein the first push-button switch is actuated by grasping the outer perimeter of the knob and pushing inward and wherein the second pushbutton switch is actuated by pushing the central portion of upper surface of the knob. Indeed, the present invention includes any combination of two or more multi-functional control assemblies, wherein at least one assembly is actuated via mechanical, electrical or other means through a bore formed in another assembly and also includes two or more assemblies wherein the state of one assembly is communicated through a bore formed in another assembly.

Various different applications of the present invention are contemplated. For example, the multi-functional control assembly of the present invention may be utilized on portable radios or televisions to mitigate the likelihood of the portable radio or television being inadvertently turned off.

Thus, these and other modifications and additions may be obvious to those skilled in the art and may be implemented to adapt the present invention for use in a variety of different applications.

What is claimed is:

1. An electric guitar, comprising:

a body;

a plurality of pickups disposed on the body; and a control assembly disposed on the body in electrical communication with the pickups, the control assembly including, (a) a rotary knob, (b) an electrical controller mechanically coupled to the rotary knob for controlling a first electrical function of the electric guitar, and (c) a pushbutton disposed within a cavity of the rotary knob for controlling a second electrical function of the electric guitar, the pushbutton extending no higher than an opening of the cavity of rotary knob to prevent activation of the second electrical function when adjusting the rotary knob to control the first electrical function.

2. The electric guitar of claim 1, wherein the pushbutton controls configuration of the plurality of pickups.

3. The electric guitar of claim 1, further including an electrical switch mechanically coupled to the pushbutton for activating the second electrical function.

4. The electric guitar of claim 3, wherein the electrical switch is disposed below the rotary knob.

5. The electric guitar of claim 3, wherein the electrical switch is disposed within the cavity of the rotary knob.

6. An electric guitar, comprising:

a body;

a pickup disposed on the body; and a control assembly disposed on the body in electrical communication with the pickup, the control assembly including, (a) a rotary controller having a shaft with a bore formed therethrough, (b) a knob coupled to the shaft, (c) a pushbutton completely disposed within a cavity of the knob, (d) a pushrod coupled to the pushbutton and disposed within the bore, and (e) an electrical switch having a linkage with the pushrod such that movement of the pushbutton causes the pushrod to actuate the electrical switch.

7. The electric guitar of claim 6, wherein the pushbutton controls configuration of the plurality of pickups.

8. The electric guitar of claim 6, wherein the rotary controller controls a first electrical function of the electric guitar and the pushbutton activating the electrical switch controls a second electrical function of the electric guitar.

9. The electric guitar of claim 8, wherein the pushbutton being completely disposed with the cavity of the knob prevents activation of the second electrical function when adjusting the knob to control the first electrical function.

10. A stringed musical instrument, comprising:

a body; and a control assembly disposed on the body for controlling first and second electrical functions of the stringed musical instrument, the control assembly including, (a) a rotary controller having a knob for adjusting the first electrical function of the stringed musical instrument, and (b) a pushbutton for controlling the second electrical function of the stringed musical instrument, wherein a contact surface of the pushbutton is disposed within a cavity of the knob.

11. The stringed musical instrument of claim 10, wherein the stringed musical instrument is a guitar having a plurality of pick-ups, the pushbutton controlling configuration of the plurality of pickups.

12. The stringed musical instrument of claim 10, further including an electrical switch mechanically coupled to the pushbutton for activating the second electrical function.

13. The stringed musical instrument of claim 12, wherein the electrical switch is disposed below the knob.

14. The stringed musical instrument of claim 12, wherein the electrical switch is disposed within the cavity of the knob.

15. A method of making a stringed musical instrument, comprising:

providing a body;

disposing a rotary controller having a knob on the body for adjusting a first electrical function of the stringed musical instrument;

providing a pushbutton for controlling a second electrical function of the stringed musical instrument; and disposing the pushbutton within a cavity of the knob so that a contact surface of pushbutton resides within the cavity of the knob.

16. The method of claim 15, wherein the stringed musical instrument is a guitar having a plurality of pick-ups, the pushbutton controlling configuration of the plurality of pickups.

17. The method of claim 15, further including providing an electrical switch mechanically coupled to the pushbutton for activating the second electrical function.

18. The method of claim 17, further including disposing the electrical switch below the knob.

19. The method of claim 17, further including disposing the electrical switch within the cavity of the knob.

* * * * *